United States Patent [19]

Shye-Long

[11] Patent Number: 4,910,385

[45] Date of Patent: Mar. 20, 1990

[54] HAIR DRYER WITH PUSH SWITCH AND INSERTION HOLDER

[75] Inventor: Chen Shye-Long, Taipei, Taiwan

[73] Assignee: Cherng Ferg Plastic Co., Ltd., Taipei Hsien, Taiwan

[21] Appl. No.: 152,397

[22] Filed: Feb. 4, 1988

[51] Int. Cl.[4] ..... H05B 1/02; F24H 3/04

[52] U.S. Cl. ..... 219/364; 34/96; 200/61.58 R; 200/61.85; 200/332.2; 219/242; 219/370; 248/282

[58] Field of Search ..... 219/364, 369, 370, 373, 219/242; 248/282; 34/96–100, 243 R; D29/17; 200/157, 61.58 R, 61.85

[56] References Cited

U.S. PATENT DOCUMENTS

| | | | |
|---|---|---|---|
| 2,678,376 | 5/1954 | Lockwood | 34/96 X |
| 4,225,106 | 9/1980 | Eplan | 248/282 X |
| 4,658,116 | 4/1987 | Tsang et al. | 219/364 |
| 4,683,369 | 7/1987 | Rieckman et al. | 219/364 |

FOREIGN PATENT DOCUMENTS

| | | | |
|---|---|---|---|
| 1065098 | 5/1954 | France | 219/364 |
| 382385 | 11/1964 | Switzerland | D28/17 |

*Primary Examiner*—Anthony Bartis

*Attorney, Agent, or Firm*—Fleit, Jacobson, Cohn, Price, Holman & Stern

[57] ABSTRACT

A hair dryer includes a hand grip with a push switch for energizing the electrical components of the dryer. The components are turned on by depression of the push switch when the grip is held by the user and are automatically turned off when the user releases the grip. A holder with an insertion socket carried by an angularly adjustable neck is provided for supporting the dryer by insertion of the hand grip into the socket. The socket includes a wall perforated by a slot. The user may insert the hand grip into the socket with the switch aligned with the slot so that the switch is not depressed and the components are not energized. Alternatively the grip may be inserted with the switch unaligned with the slot so that the switch is depressed by the socket wall to energize the components.

18 Claims, 6 Drawing Sheets

HAIR DRYER WITH PUSH SWITCH AND INSERTION HOLDER

BACKGROUND OF THE INVENTION

1. Technical Field

The present invention is related to a hair dryer with a push switch and insertion holder which switch is turned on to start dryer motor rotation when the grip is held by the user and turned off to stop motor rotation when the user releases his or her hand from the grip.

2. Background Discussion

Most switches with HI, LO and OFF positions for conventional hair dryers are built in one, integral structure and without insertion holders. During use, these structures have the following drawbacks.

In the first place, since the switches with HI, LO and OFF positions for conventional hair dryers are built in one, integral structure, the user has to push the switch to turn the dryer on or off, which is inconvenient. In case the user drops the dryer or neglects it, it will cause danger by the motor continuously rotating. Even during use, if the user forgets to turn it off before he or she leaves it behind to answer the telephone or to do something else, the dryer will continue to operate, which is obviously very dangerous.

In the second place, since the conventional hair dryer is not equipped with a holder to receive and fix it therein, the user has to hold the grip of the dryer with one hand and comb his or her hair with the other hand. The user cannot fix the dryer in a certain position and comb his or her hair with both hands at the same time, making it rather inconvenient for the user to use the conventional hair dryer.

The present inventor has been engaged in manufacturing the concerned products and is well experienced in the research and development thereof. In view of the foregoing drawbacks of the design of conventional hair dryers, he has invented a hair dryer with a push switch and insertion holder without any of the foregoing drawbacks in the interest of convenient use by the consumers in general.

SUMMARY OF THE INVENTION

A hair dryer with a push switch and insertion holder of this invention is characterized by a novel design and structure. A push switch is provided in the grip of the hair dryer. When the user holds or squeezes the grip, the hair dryer is turned on. When the user releases the grip, the hair dryer is automatically turned off. The dryer of the invention is very safe to use. In addition, the present invention is also provided with an insertion holder for receiving the grip of a hair dryer inserted therein, and the user can fix the dryer in the holder in a first position holding the push switch depressed and comb his or her hair with both hands, making it very convenient for the user to use the present invention. The holder includes a socket having a slot along one side which enables a user to place the grip into the socket in a second position with the push switch released.

DETAILED DESCRIPTION OF THE PREFERRED EMBODIMENT

Figure 1:
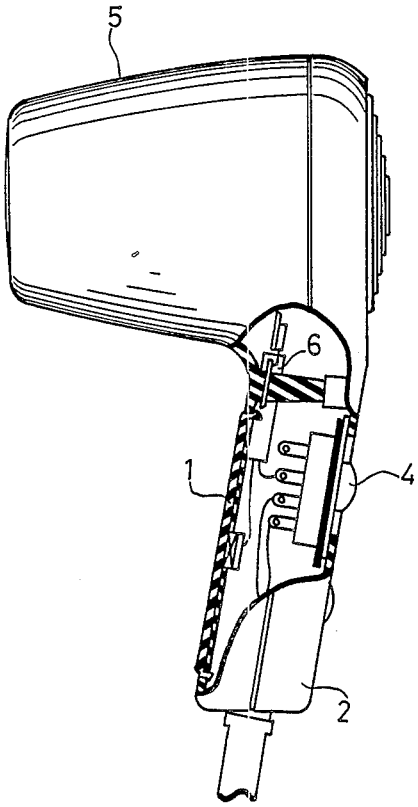
FIG. 1 is a structural section view of the push switch of the present invention installed on the grip of the hair dryer.
Figure 2:
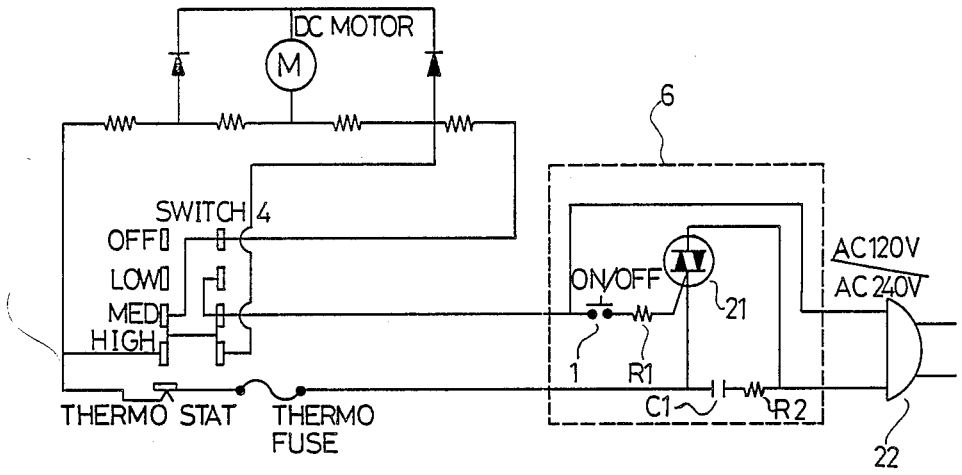
FIG. 2 is a wiring scheme of the present invention.

As shown in FIGS. 1 and 2, a push switch (1) is provided to the front of grip (2), a switch (4) with HI, MED and LO (or HI, OFF and LO) positions is provided to the back of grip (2), and the switch (4) is designed to let the user select the proper hair dryer speed. Then he or she may hold the push switch (1) on the grip (2) and the motor in the hair dryer (5) can rotate in line with the rotary speed selected by the user. In addition, a hermetical waterproof block (6) is installed in the grip (2) to cover the wiring of the electrical circuit and to prevent the moisture from infiltrating into it. The circuit within grip (2) includes push switch (1) coupled to one side of a wall plug (22) and, via resistance R1, to a gate of TRIAC (21) and series coupled capacitance C1 and resistance R2 connected between a node electrodes of TRIAC (21) and to the other side of plug (22).

The operation of the present invention as shown can be understood by reference to FIGS. 1 and 2. Prior to use, the user may push the switch (4) to a desired position of HI or MED or LO. He then holds the grip (2) so that his hand touches and presses the push switch (1). As can be seen, it is natural to hold the grip when using the dryer, therefore squeezing the push switch (1) is a natural process and action. The hair dryer is turned on by the switch (1) thus causing the rotation of the motor. When the user releases his or her hand from the grip (2), the hair dryer is turned off to form an open circuit and to stop the motor rotation. The operation of the present invention is characterized by safety: even in use, should the user leave the hair dryer behind to do something else, the dryer will never cause any danger since the power source thereof has been cut off automatically.

Figure 4:
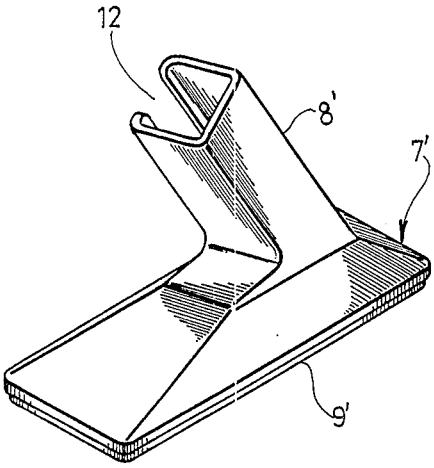
FIG. 4 is another structural view of the insertion holder of the present invention.
Figure 5:
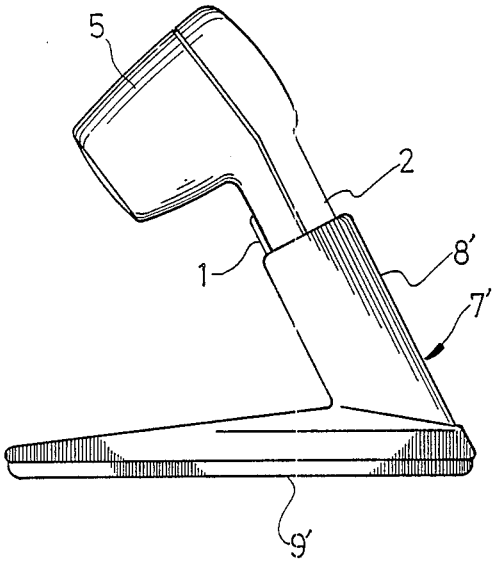
FIG. 5 shows the hair dryer of the present invention inserted in the holder with the push switch depressed.

In operation and use, the present invention may be inserted in a holder (7) to fix the hair dryer (5) therein as shown in FIGS. 4 and 5. Thus, the user can use both hands to comb his or her hair as he or she likes. It is not necessary for the user to hold the dryer, therefore it is more convenient to operate the dryer.

Figure 3:
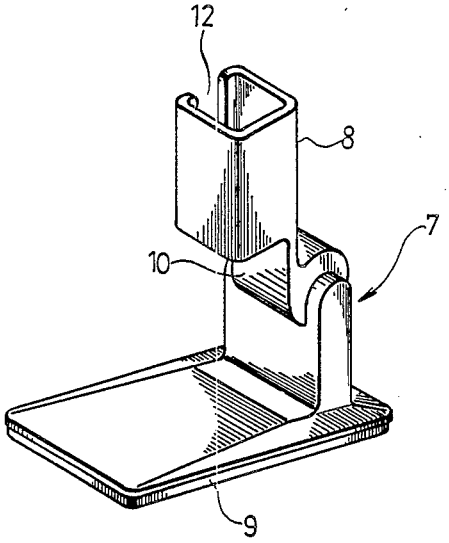
FIG. 3 is a structural view of the insertion holder of the present invention.
Figure 6:
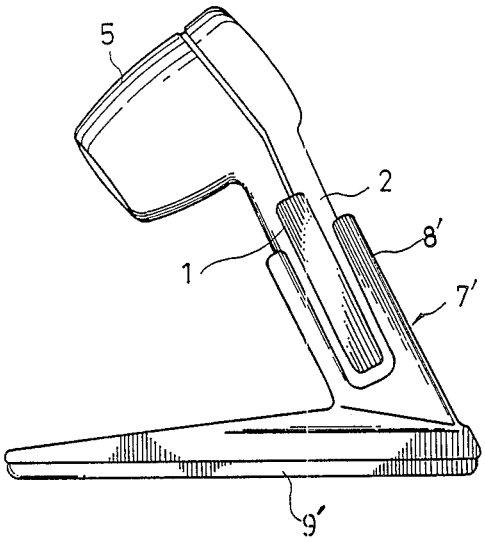
FIG. 6 shows the hair dryer inserted into the holder.

The structure of said holder (7) can be conformed to the structures as shown in FIGS. 3 and 4. FIG. 3 shows a holder (7) with an adjustable rotary angle, wherein a rotary angularly adjustable neck (10) is provided at a position between a socket (8) and a base (9), and the user can easily adjust the socket (8) to a suitable hair drying angle. In addition, a slot (12) is provided in a wall of a socket (8) so that when the user wants to turn off the dryer, the user may place the front of grip (2) with the push switch (1) toward the direction of slot (12) to release the push switch as shown in FIG. 6, and the dryer (5) will stop rotating. Thus, the holder (7) may be used to hold the dryer (5) during periods of non-use. Furthermore, the insertion holder (7) may be designed as a fixed type as shown in FIGS. 4 and 5, namely, the neck thereof cannot be arcuately adjusted, in order to offer one more model for the consumers' choice. Holder (7') of FIGS. 4 and 5 has an elongated socket (8') fixed to an extending upward from a base (9'). The socket (8') is perforated by slot (12).

In view of the above, the primary purpose of the present invention is to offer a hair dryer with a push switch turn on the dryer rotate when the user holds the grip of the dryer, and the power source of the dryer can be cut off automatically when the user releases his or her hand from the grip; therefore, in comparison with the conventional hair dryers, the operation of the present invention is much safer.

The secondary purpose of the present invention is to offer a hair dryer with an insertion holder so that the user can fix the dryer into the holder when he or she operates the dryer, and can use both hands to comb his or her hair, which is much more convenient of the use of a traditional dryer.

In summary, the present invention is characterized by the foregoing advantages such as unprecedented function and practicability and it is obviously a practical product for structural design.

I claim:

1. A hair dryer, comprising:

a hair dryer including an electrically energizable motor;

a hand grip affixed to said hair dryer, said grip having an elongated push switch, said push switch being arranged so that (1) said hair dryer is turned on to start said motor rotating when said push switch is depressed and (2) said hair dryer is automatically turned off to stop said motor from rotating when said push switch is released;

an insertion holder having a socket adapted to removably receive said grip, said insertion holder having an elongated slot in a side wall of said socket, said hair dryer being selectively mountable by said grip in said holder socket in one of two conditions, a first condition wherein said push switch is not aligned with said slot so that said push switch is depressed by said side wall whereby said switch enables current flow to the motor, and a second condition wherein said push switch is aligned with said slot so that said push switch is released whereby the switch interrupts current flow to the motor.

2. The hair dryer of claim 1 wherein said push switch is provided on the front of said grip so that when said grip is held, said switch can be pressed and when said grip is released said switch is released.

3. The hair of claim 1 wherein a back of said hair dryer is provided with a second switch having HI, MED and LO or HI, OFF and LO positions for adjusting a speed of rotation of said motor of said hair dryer.

4. The hair dryer of claim 1 wherein a hermetical waterproof block is provided to an interior of said grip in order to cover wiring and prevent moisture from infiltrating thereinto.

5. The hair dryer of claim 1, wherein the holder has a base and a rotary neck adjustably connecting the holder to the base.

6. The hair dryer of claim 1 wherein said holder is fixed, a neck including said socket of said fixed holder being fixed in position relative to a base of said holder.

7. An appliance, comprising:

an appliance having an electrically energizable component and a hand grip for manipulation of said appliance, said appliance including normally open electrical switching means including an actuator disposed on a hand grip in a location engagable by the hand of a user while holding the appliance, for enabling flow of electrical current into the component when said switching means is actuated engaged by the hand of a user and for interrupting said flow of electrical current into the component when said switching means is actuator not engaged by the hand of a user; and means for supporting said appliance and including socket means for receiving the hand grip bearing said switching means actuator in a plurality of different conditions, wherein a wall defining said socket means engages said actuator of said switching means to close said switching means thereby enabling said flow of electrical current of said component, said socket means being perforated along one side by an opening, said socket means receiving said hand grip in a second position wherein the actuator of said switching means is aligned with said opening so that said actuator does not engage the wall defining said socket means whereby the switching means is open to interrupt said socket means whereby the switching means is open to interrupt the flow of electrical current to said component.

8. The switch mechanical of claim 7, wherein said switching means is provided on a front of said hand grip, whereby when said hand grip is held by a user, said switching means enables flow of electrical current to said component and when the hand grip is released by a user said switching means is released to interrupt said flow of electrical current to said component.

9. The appliance of claim 7, further comprised of a second switch disposable on the hand grip, said second switch having a plurality of positions for adjusting modes of operation of the electrical component of the appliance.

10. The appliance of claim 7, further comprised of a hermetical waterproof block disposable within an interior of the grip to prevent moisture from infiltrating electrical wiring connectable to said electrical switching means.

11. The appliance of claim 7, wherein said supporting means comprises a base adjustably connected to and supporting said socket means.

12. The appliance of claim 7, wherein said supporting means further comprises a base supporting said socket means in a fixed orientation relative to said base.

13. An appliance, comprising:

a hand-holdable appliance having an electrically energizable component and a hand grip for the manipulation of an appliance, said hand grip including electrical switching means disposable on the hand grip in a location engaged by the hand of a user while holding the appliance, said switching means being arranged to enable flow of electrical current to said component of the appliance when said switching means is engaged by the hand of a user and for interrupting said flow of electrical current to said component of the appliance when said switching means is not engaged by the hand of a user; and means for supporting said appliance and including socket means for receiving the hand grip bearing said switching means in a plurality of different conditions, wherein a wall defining said socket engages said actuator of said switching means to close said switching means thereby enabling said flow of electrical current to said component, said socket means being perforated along one side by an opening, said socket means receiving said hand grip in a second position wherein the actuator of said switching means is aligned with said opening so that said actuator does not engage the socket means wall whereby the switching means is open to interrupt the flow of electrical current to said component.

14. The switch mechanism of claim 13, wherein said switching means is provided on a front of said hand grip, whereby when said hand grip is held by a user, said switching means enables flow of electrical current to said electrical component of the appliance and when the hand grip is released by a user, said switching means is released to interrupt said flow of electrical current into the electrical component.

15. The appliance of claim 13, further comprised of a second switch disposable on the hand grip, said second switch having a plurality of positions for adjusting modes of operation of said electrical component of the appliance.

16. The appliance of claim 13, further comprised of a hermetical waterproof block disposable within an interior of the grip to prevent moisture from infiltrating electrical wiring connectable to said electrical switching means.

17. The appliance of claim 13, wherein said supporting means comprises a base adjustably connected to and supporting said socket means.

18. The appliance of claim 13, wherein said holder further comprises a base supporting said socket means in a fixed orientation relative to said base.

* * * * *